US010400598B2

(12) United States Patent
Kulmagambetov et al.

(10) Patent No.: US 10,400,598 B2
(45) Date of Patent: Sep. 3, 2019

(54) METHOD FOR LIFTING OF MAGMATIC LAVA TO THE SURFACE

(71) Applicant: LAITINGEN FINANCIAL INC., Tortola (VG)

(72) Inventors: Anuar Rajhanovich Kulmagambetov, Moscow (RU); Vladimir Il'ich Bodyakin, Chimki (RU)

(73) Assignee: Anuar Rajhanovich Kulmagambetov, Moscow (RU)

( * ) Notice: Subject to any disclaimer, the term of this patent is extended or adjusted under 35 U.S.C. 154(b) by 507 days.

(21) Appl. No.: 14/768,640

(22) PCT Filed: Sep. 29, 2014

(86) PCT No.: PCT/RU2014/000730
§ 371 (c)(1),
(2) Date: Aug. 18, 2015

(87) PCT Pub. No.: WO2016/024879
PCT Pub. Date: Feb. 18, 2016

(65) Prior Publication Data

US 2016/0251959 A1 Sep. 1, 2016

(30) Foreign Application Priority Data

Aug. 12, 2014 (RU) ..... 2014133067

(51) Int. Cl.
*E21B 43/12* (2006.01)
*E21C 41/00* (2006.01)
*F04F 1/14* (2006.01)

(52) U.S. Cl.
CPC ..... *E21C 41/00* (2013.01); *E21B 43/12* (2013.01); *F04F 1/14* (2013.01)

(58) Field of Classification Search
CPC ..... E21B 43/12; E21B 43/122; E21B 43/285
(Continued)

(56) References Cited

U.S. PATENT DOCUMENTS 533,224 A * 1/1895 Merrill
1,427,317 A * 8/1922 Oliphant ..... F04F 1/14 417/109

(Continued)

FOREIGN PATENT DOCUMENTS

RU 2005131294 4/2007
RU 2006103014 8/2007

(Continued)

OTHER PUBLICATIONS

International Search Report dated Apr. 29, 2015.

(Continued)

*Primary Examiner* — Taras P Bemko
(74) *Attorney, Agent, or Firm* — Dmitry S. Kryndushkin

(57) ABSTRACT

Invention relates to the mining industry and may be used for magmatic lava extraction and lifting to the surface for further processing. The disclosed method comprises using a carrier pipe for lava lifting and a smaller diameter pipe for injection of an incombustible gas, wherein the pipes are connected via a disperser. The carrier pipe and the disperser have a plurality of holes of various diameters to ensure efficient lava saturation by gas. The dispenser is preferably designed as cowl concentrically wrapped around carrier pipe. The effect of lava lifting through the carrier pipe is achieved via repetitive lowering and lifting motions of the carrier pipe with simultaneous lava saturation with the gas inside the carrier pipe, which lowers the lava viscosity. After stabilization of the flow velocity of the gas-saturated lava from the carrier pipe, the lava lifting process is changed to lava collection conditions.

5 Claims, 2 Drawing Sheets

(58) Field of Classification Search
USPC ..... 166/372
See application file for complete search history.

(56) References Cited

U.S. PATENT DOCUMENTS 3,468,387 A * 9/1969 Benson ..... E21B 7/15 175/16
4,241,953 A * 12/1980 Bradford ..... E21B 43/285 299/4
4,347,899 A 7/1982 Weeter
4,869,555 A * 9/1989 Peters ..... B01D 17/0208 299/4
7,284,931 B2 * 10/2007 Stratford ..... F03G 7/04 166/302
2009/0126235 A1 * 5/2009 Kobayashi ..... E21B 7/00 37/195
2009/0145595 A1 * 6/2009 Mazzanti ..... E21B 17/18 166/106
2011/0168413 A1 * 7/2011 Bachtell ..... E21B 43/122 166/401
2011/0272148 A1 * 11/2011 Lovell ..... E21B 17/206 166/250.17

FOREIGN PATENT DOCUMENTS

RU 2012112674 10/2013
SU 1182203 9/1985

OTHER PUBLICATIONS

Translation of International Search Report dated Apr. 29, 2015.
Written Opinion of the International Searching Authority dated Apr. 14, 2015.

* cited by examiner

METHOD FOR LIFTING OF MAGMATIC LAVA TO THE SURFACE

CROSS-REFERENCE TO RELATED APPLICATION

The instant application is a national phase of PCT International Application No. PCT/RU2014/000730, filed on Sep. 29, 2014, and claims priority to Russian Patent Application Serial No. 2014133067, filed on Aug. 12,2014, the entire specifications of both of which are expressly incorporated herein by reference.

PERTINENT ART

Invention relates to the mining industry and may be used for lava extraction from magma lakes, located in the crater of active volcanoes, in the cavity of sleeping volcanoes or near them, both with and without exit to the surface.

BACKGROUND OF THE INVENTION

There is available method for lifting of magmatic lava to the surface from the magmatic lava source—volcano—with the help of excavation machine, consisting of power shovel and bucket conveyor. In accordance with available method, one part of the excavation machine is installed outside the volcano and the other part is lowered inside the volcano, while the conveyor moves buckets so that the lower bucket scoops lava and moves it from the crater to the site outside the volcano (RU 2006103014 A, 20, Aug. 2007).

Shortcomings of available method amount to high hazard for personnel and limited depth of magmatic lava extraction.

There is available method for lifting magmatic lava to the surface from magmatic lava source—volcano—with the help of pipes and pumps (RU 2006103014 A, 20, Aug. 2007).

Shortcomings of this method also amount to its limited capacity due to underestimation of particular features of magmatic lava, characterized by high temperature and viscosity which make difficult application of convenient pumps, as well as controllability and steadiness of operation in lifting magmatic lava to the surface.

BRIEF SUMMARY OF THE INVENTION

Technical result of the invention is improvement of its efficiency by increasing of magmatic lava lifting depth, providing safety, steadiness and controllability of the lifting operations for further lava processing.

Necessary technical result is achieved because lifting method is characterized by application of a carrier pipe for the lifting of lava and a smaller diameter pipe for injection of incombustible gas, connected to the carrier pipe by a disperser at a specified depth. The length of the disperser is between 5 and 75% of the length of the carrier pipe, the carrier pipe having many holes of various diameters. Technical result is achieved with the help of following steps:

a) the carrier pipe is lowered into a lava source in such a way so its upper part is 1-2 m above the lava level;

b) gas is injected into the disperser until lava inside the carrier pipe is at least partially saturated;

c) the carrier pipe is further lowered into the lava source with overflowing of lava back into the lava source and is kept this way until lava inside the carrier pipe is uniformly or further saturated by gas;

d) steps a)-c) are repeated until a start of steady motion of lava inside the whole carrier pipe;

e) along with stabilization of the flow velocity of the gas saturated lava from the carrier pipe, the lava lifting process changes to steady-state conditions, for which purpose the carrier pipe is installed at a specified depth with a previous air-tight connection to the receiving system on the surface and a fumarole gas trap system—it is used as incombustible gas for injection into the disperser.

Additionally:

fumarole and/or incombustible gas from an external source is additionally used for injection into the disperser;

gas for injection into the disperser contains a vapor-gas mixture;

lifted in the carrier pipe, lava is treated by ultrasonic and/or electrical discharges and, if necessary, additionally treated by a controlled magnetic field;

the disperser is designed as a cowl concentrically wrapped around the carrier pipe, which is perforated inside the cowl and has flexible sleeves, directed to the pipe center. Sleeves are connected with some holes (perforations) and can move inside carrier pipe, in lava flow, in relation to its inner walls. Besides that, sleeves have holes for exit of injected from the cowl gas.

Essence of the invention amounts to the fact that gas-lift (air lift) is basically used for the lifting of magmatic lava, taking into account special lava features. Due to higher viscosity and inhomogeneous structure of magmatic lava as well as its high temperature, prior to steady-state process of lava lifting to the surface should be applied special methods for the start of lifting process with the help of a device which provides volume saturation of magmatic lava by gas and/or gas-vapor mixture with simultaneous volume dispersion of the lava itself. Trials showed that volume saturation effect and simultaneous volume dispersion are achieved when the disperser's length is 5-75% of the length of the carrier pipe with holes of various diameters. Incombustible gas is used in all operation for lifting of magmatic lava which ensures necessary safety of the lifting due to exclusion of additional uncontrollable fire sources in danger area.

Vapor may be added to the incombustible gas for further stabilization of gas saturation and dispersion processes in lifted lava. On the launching stage neutral gases may be used as incombustible gas, and after that fumarole gases, generated in lifted lava and trapped during its lifting from the source and/or surface transportation. It ensures localization of toxic gases and also steady temperature conditions in the operational area. If there is shortage of mentioned gases, incombustible gases or mixtures from external sources—other facilities may be used.

DETAILED DESCRIPTION OF THE INVENTION

Method is embodied in the following way.

Figure 1:
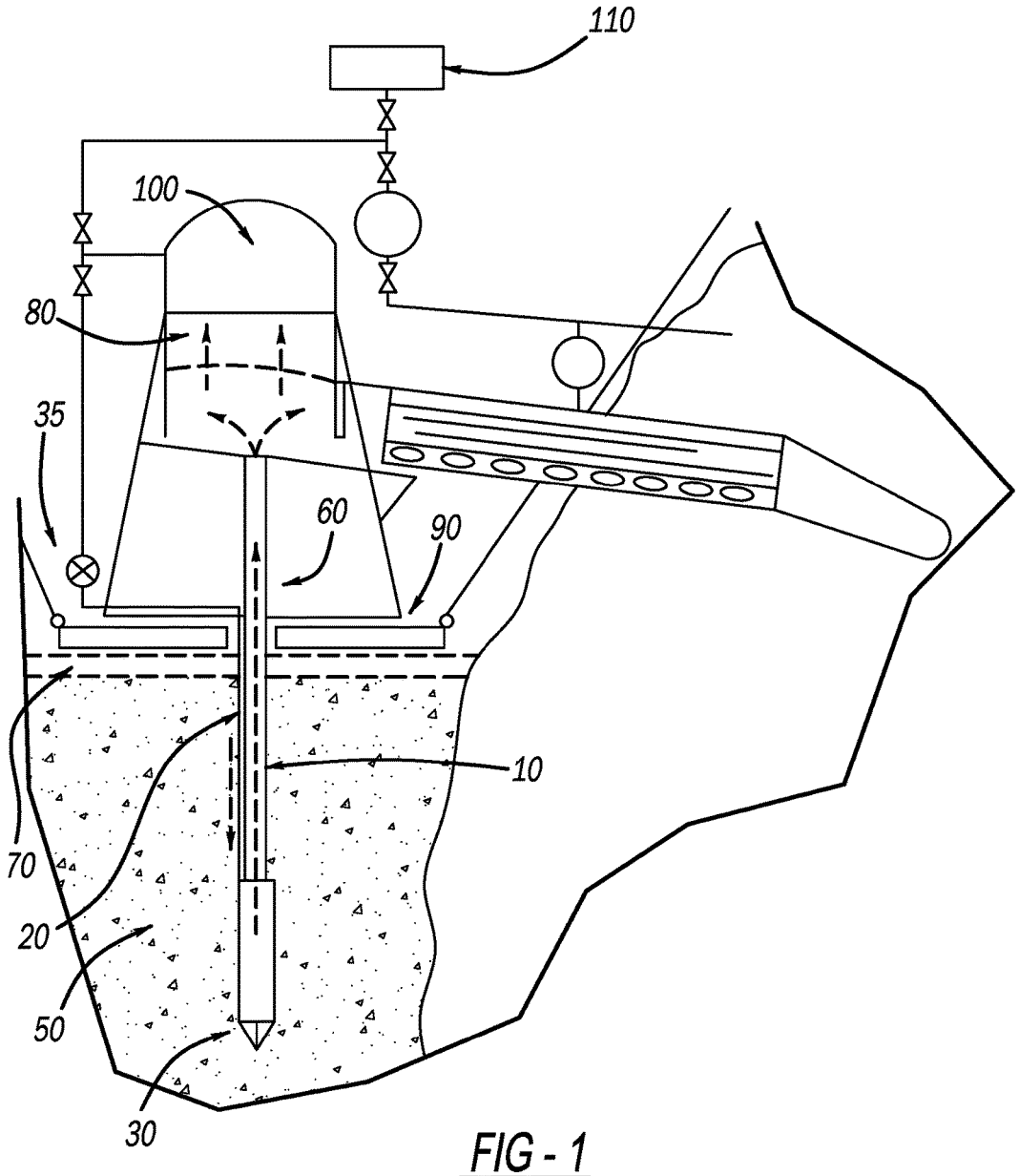
FIG. 1 is a partial schematic view of an exemplary system for lifting of magmatic lava to the surface according to the general teaching of the present invention.
Figure 2:
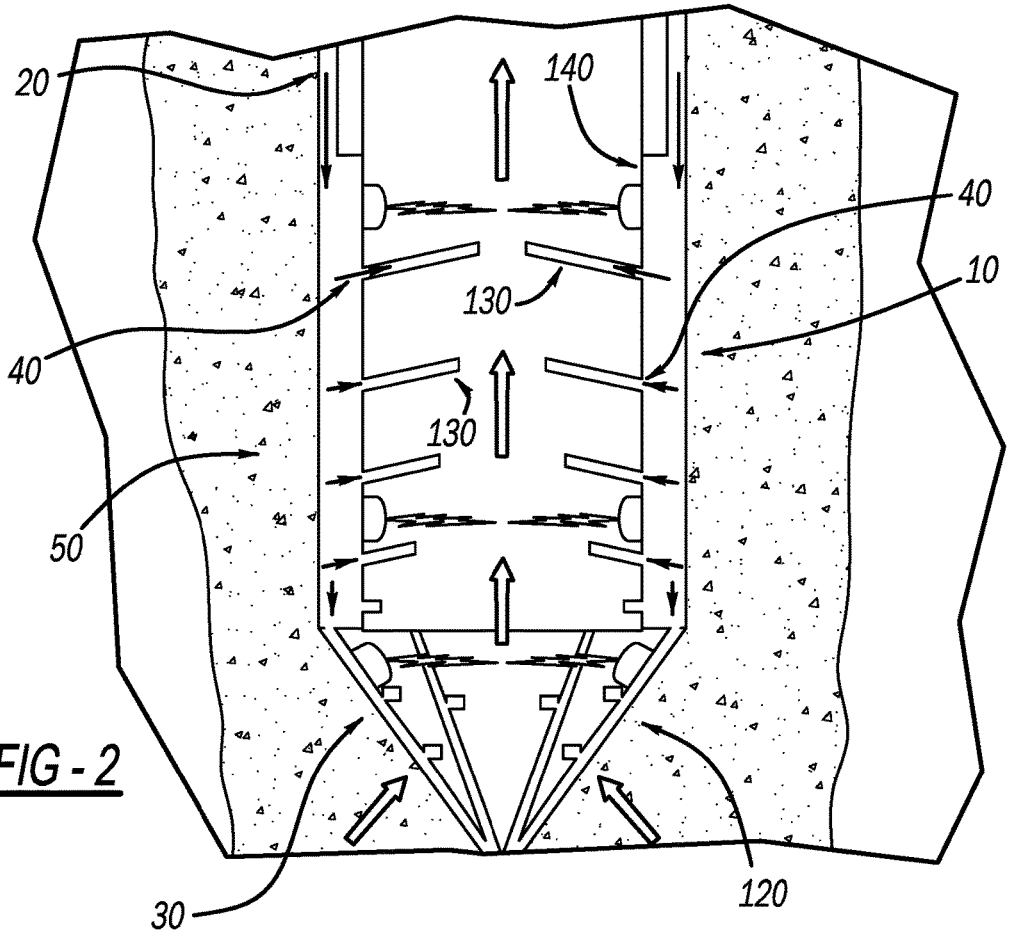
FIG. 2 is a partial sectional view of the lower portion of the system showing, for example, the disperser and carrier pipe.
Figure 3:
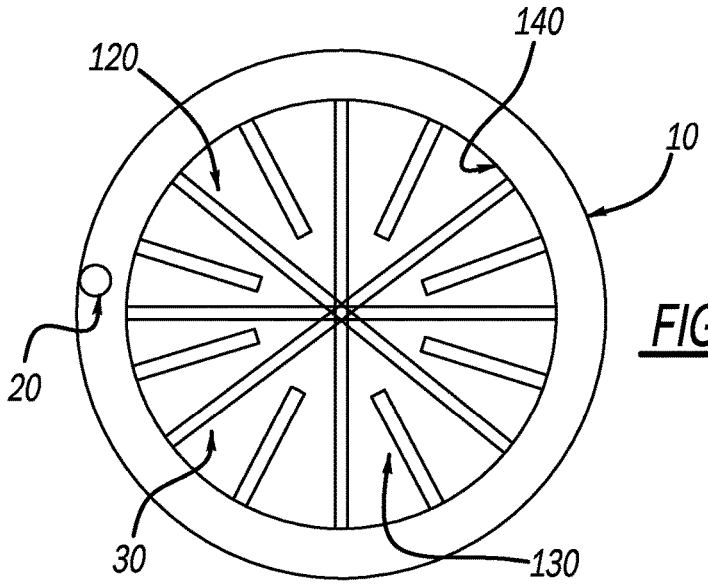
FIG.3 is an end view of the lower portion of the system showing, for example, the disperser and carrier pipe.

Reference is made to FIGS. 1-3, wherein FIG. 1 is a partial schematic view of an exemplary system for lifting of magmatic lava to the surface according to the general teachings of the present invention, FIG.2 is a partial sectional view of the lower portion of the system showing, for example, the disperser and carrier pipe, and FIG.3 is an end view of the lower portion of the system showing, for example the disperser and carrier pipe.

Gas-lift is lowered into magmatic lava source. For this, a carrier pipe 10 is used for lava lifting and a smaller diameter pipe 20 for injection of an incombustible gas, connected to the carrier pipe 10 by a disperser 30 at a specified depth. The length of disperser 30 is between 5 and 75% of the length of the carrier pipe 10, wherein the carrier pipe 10 is provided with many holes 40 of various diameters. The following steps should be carried out:

a) the carrier pipe 10 is lowered into a lava source 50 in such a way so its upper part 60 is 1-2 m above the lava level 70;

b) gas is injected into the disperser 30 from a gas source 35 until lava inside the carrier pipe 10 is at least partially saturated with gas;

c) the carrier pipe 10 is further lowered into the lava source 50 with overflowing of lava back into the lava source 50, and is kept this way until lava inside the carrier pipe 10 is uniformly or further saturated by gas;

d) steps a)-c) are repeated until a start of steady motion of lava inside the whole carrier pipe 10;

After that starts steady-state mode of lava lifting. For this purpose, the carrier pipe 10 is installed at a specified depth with a previous air-tight connection to the receiving system 80 in the surface 90 and a fumarole gas trap system 100—it is used as incombustible gas for injection into the disperser 30.

If necessary, additional fumarole and/or incombustible gas from external sources 110 are used as injection gas—for example, fumarole gas from another magmatic lava source or combustion gases from processing facilities.

In the case of insufficient capacity of magmatic lava lifting, the carrier pipe 10 is treated by ultrasonic and/or electrical discharges.

For better effects of magmatic lava saturation by gas and dispersion of lava itself, the disperser 30 is designed as a cowl 120 concentrically wrapped around the carrier pipe 10. The carrier pipe 10 is perforated inside the cowl 120 and has flexiblesleeves 130, adjacent to the perforated holes 40, with the possibility of the flexible sleeves 130 to move inside the carrier pipe 10, in lava flow, in relation to the inner walls 140 of the carrier pipe 10. So volume gas saturation is achieved due to gas injection into magma from many holes with various diameters, located both on the carrier pipe's inner surface and on the sleeves.

Specific example of the method implementation.

There is a lava lake of the Ploskiy Tolbachik volcano on Kamchatka. This lake is located directly at the crater's western boundary and is a round pit with 300 meters diameter and depth up to 50 meters. Temperature of the magmatic lava in the lake is about 1000° C.; lava is saturated by volcano gases. To start extraction of magmatic lava, at the crater's edges are installed supports for cable lines, with the help of which a platform with a hole is steadily lowered on the lava lake surface. Two pipe columns are lowered into magmatic lava through the hole—for example, pipes can be manufactured from shock-resistant ceramic reinforced material, able to withstand high temperatures (over 1500° C.). Then a carrier pipe with 2-3 m diameter and reinforcing ribs is selected. It serves for lifting of magmatic lava. Pipe with a smaller diameter—100-200 mm—is used for injection of incombustible gas or incombustible vapor-gas mixture. These pipes are installed in such a way that at the depth of 25 m they are connected by a volumetric disperser. Disperser is designed as sleeves, placed both along an inner surface of the carrier pipe and at an angle to lava flow, up to its central part in the carrier pipe, with holes of various diameters (4-10 mm), protected from intake of magma by the fine mesh. In the launching mode following steps should be performed:

a) exit hole of the carrier (lifting) pipe is lowered to the face of magma lake and immersed into lava source so its upper part is 1 m higher than the lava level;

b) incombustible gas—for example, nitrogen—is injected into disperser until lava inside carrier pipe is saturated;

c) carrier pipe is lowered into lava source with overflowing of lava into lava source and is kept this way until lava inside the carrier pipe in uniformly saturated by gas;

d) steps a)-c) are repeated until start of steady motion of lava inside the whole carrier pipe;

After that starts steady-state mode of lava lifting. For this purpose carrier pipe is fixed at the depth of 35-50 m with previous air-tight connection to the receiving system in the surface and fumarole gas trap system—it is used as incombustible gas for injection into disperser.

Disperser is started with necessary capacity in steady mode.

For a more effective launch of the gas-lift and subsequent start of operations in the steady-state mode, a disperser, manufactured in accordance with specification, can be used. Tubes of this disperser, crossing the carrier pipe cross-section, generate additional sources for the lava flow volumetric gas saturation. Since the disperser's tubes are fixed to the carrier pipe wall in such a way so they have a free end and can be elastically bent to the carrier pipe wall and return to original position, it ensures passage even for solid bits of magmatic rocks.

For improvement of lava passage through the carrier pipe and further lava processing, this method includes possible treatment of magmatic flow by controlled magnetic field, as well as electrical and ultrasonic treatments for lifted magmatic lava, for destruction of existing physical inhomogeneity.

Also, for accelerated launch of the device, may be used disperser-accelerator in the form of "graphite" rods (by analogy with nuclear reactors), put from above into carrier pipe at the initial technological stage, where electrical discharges are passed among rods to "shake" magma.

After starting mode in the lifting pipe, carrier pipe is connected to the surface piping. Receiving reservoir is installed near the carrier pipe exit hole; its bottom is inclined in the direction of conveying trough, designated for the lava surface transportation. Receiving reservoir should be equipped by gas-vapor separator and gas-vapor discharge system, as well as compressor for suction of fumarole gases.

In the design should be included suction of fumarole gases from magmatic lava with the help of compressor. As a result pressure in the receiving reservoir is lower than atmospheric pressure, which additionally aids lifting of magmatic lava and generation of fumarole gases. Amount of magmatic lava, lifted to the surface, is regulated by compressor operation through increased or decreased volume of pumped into disperser incombustible gas.

To lower or prevent intake of "non-processed" and "out-sized" solid bits of magmatic rock into gas-lift carrier pipe, on the lifting pipe entrance should be installed mechanical conical filter.

INDUSTRIAL APPLICABILITY

The invention is applied for extraction of magmatic lava from magma lakes located in the crater of active volcanoes, in the cavity of sleeping volcanoes or near them, both with and without exit to the surface.

The invention claimed is:

1. A method for lifting of magmatic lava to the surface of the land from a lava source, comprising the steps of:

a) providing a carrier pipe for lava lifting and a smaller diameter pipe for injection of an incombustible gas, wherein the smaller diameter pipe is connected to the carrier pipe by an incombustible gas injection disperser, wherein the disperser has a length between 5% and 75% of a length of the carrier pipe, wherein the carrier pipe includes a plurality of holes of various diameters formed therein;

b) placing the carrier pipe into the lava source such that a portion of said carrier pipe is 1 to 2 meters above the lava level;

c) injecting the incombustible gas into the carrier pipe via the disperser until lava inside the carrier pipe is at least partially saturated by the gas;

d) making at least two lifting and lowering motions of the carrier pipe respective to the surface of the land so as to start a motion of lava saturated by the gas inside the carrier pipe;

e) repeating step d) until most of the lava inside the carrier pipe is saturated by the gas and a steady motion of lava inside the carrier pipe is achieved;

f) while continuously injecting the incombustible gas into the carrier pipe, installing the carrier pipe into the lava source at a specified depth to provide a connection of the carrier pipe with the lava receiving system on the surface.

2. The method according to claim 1, wherein a fumarole is used as the incombustible gas.

3. The method according to claim 1, wherein a vapor-gas mixture is used as the incombustible gas.

4. The method according to claim 1, further comprising a step of subjecting lava inside the carrier pipe to an ultrasonic or electrical discharge using an ultrasonic or electrical discharge treatment.

5. The method according to claim 1, wherein the disperser is configured to be concentrically wrapped around the carrier pipe; and the carrier pipe includes a plurality of flexible sleeve members disposed on an inner surface of said carrier pipe.

* * * * *